US005101998A

United States Patent [19]

Hwang

[11] Patent Number: 5,101,998

[45] Date of Patent: Apr. 7, 1992

[54] SPACE ADJUSTMENT DEVICE OF A BLOW TORCH

[76] Inventor: Jin-Chyuan Hwang, No. 118-209, Tai Tzu Miao, Tai Tzu Tsun, Jen Te Hsiang, Tainan Hsien, Taiwan

[21] Appl. No.: 712,700

[22] Filed: Jun. 10, 1991

[51] Int. Cl.[5] ..... B65D 25/28

[52] U.S. Cl. ..... 220/94 R; 431/343; 215/100 A; 222/465.1; 222/474

[58] Field of Search ..... 431/343, 344; 215/100 A; 222/180, 465.1, 474; 248/682; 220/94 R

[56] References Cited

U.S. PATENT DOCUMENTS 3,191,819 6/1965 Smith ..... 220/94 R
3,659,791 5/1972 Clark ..... 222/474
3,979,011 9/1976 Schleicher ..... 220/94 R
4,098,436 7/1978 Kohlbeck ..... 222/474

*Primary Examiner*—Carroll B. Dority

[57] ABSTRACT

A space adjustment device of a blow torch comprising a tray, a retainer spaced from the tray for supporting a burner, an adjustable handle interconnecting the tray and the retainer, a ratchet mechanism fitted in the adjustable handle and used to prevent collapsing of the adjustable handle and a control unit associated to the ratchet mechanism and applicable to release the ratchet mechanism for a space adjustment between the retainer and the tray to fit a gas cassette of any of several standard sizes to the blow torch.

1 Claim, 3 Drawing Sheets

SPACE ADJUSTMENT DEVICE OF A BLOW TORCH

FIELD OF THE INVENTION

The present invention relates to an improved structure of a space adjustment device of a blow torch.

BACKGROUND OF THE INVENTION

Plumber's torches are widely used for a soldering or brazing treatment. For more convenience in operation, gas is used instead of some traditional fuels such as benzine and alcohol. The gas is usually accommodated in a metal container of a cassette type, which is commonly and hereinafter named as a cassette, for replacement when being run out of gas. There are two to three sizes of the cassette applicable to a blow torch which has a device for fitting the cassette. A space adjustment device is necessary to a blow torch of such type so as to receive different sizes of the cassette.

SUMMARY OF THE INVENTION

It is accordingly a primary object of the present invention to provide a space adjustment device of a blow torch to receive different sizes of cassette.

With the above objective in view, the present invention provides a space adjustment device for a blow torch which includes a tray, a retainer spaced from tray for supporting a buner, an adjustable handle interconnecting the tray and the retainer, a ratchet mechanism fitted in the adjustable handle and used to prevent collapsing of the adjustable handle and a control unit associated to the ratchet mechanism and applicable to release the ratchet mechanism for a space adjustment between the retainer and the tray to fit a gas cassette of any of several standard sizes to the blow torch.

BRIEF DESCRIPTION OF THE DRAWINGS

FIG. 2A$^x$ is an enlarged view of the circled area in FIG. 2

FIG. 2-Y is side view of the pawl and its actuating mechanism as encircled in FIG. 2.

DETAILED DESCRIPTION OF A PREFERRED EMBODIMENT

Figure 1:
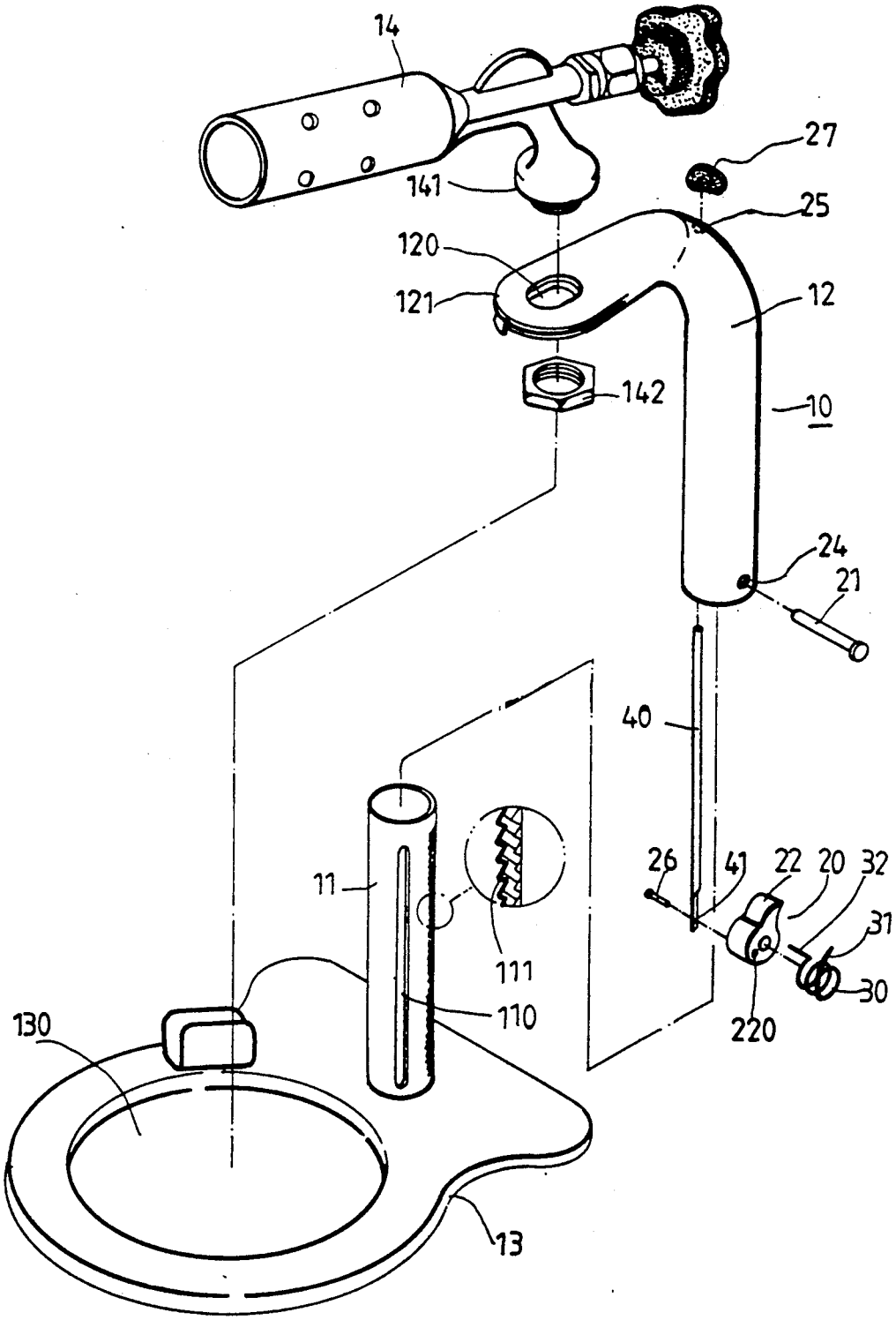
FIG. 1 is a perspective and exploded view of a space adjustment device of a blow torch according to the present invention.
Figure 2:
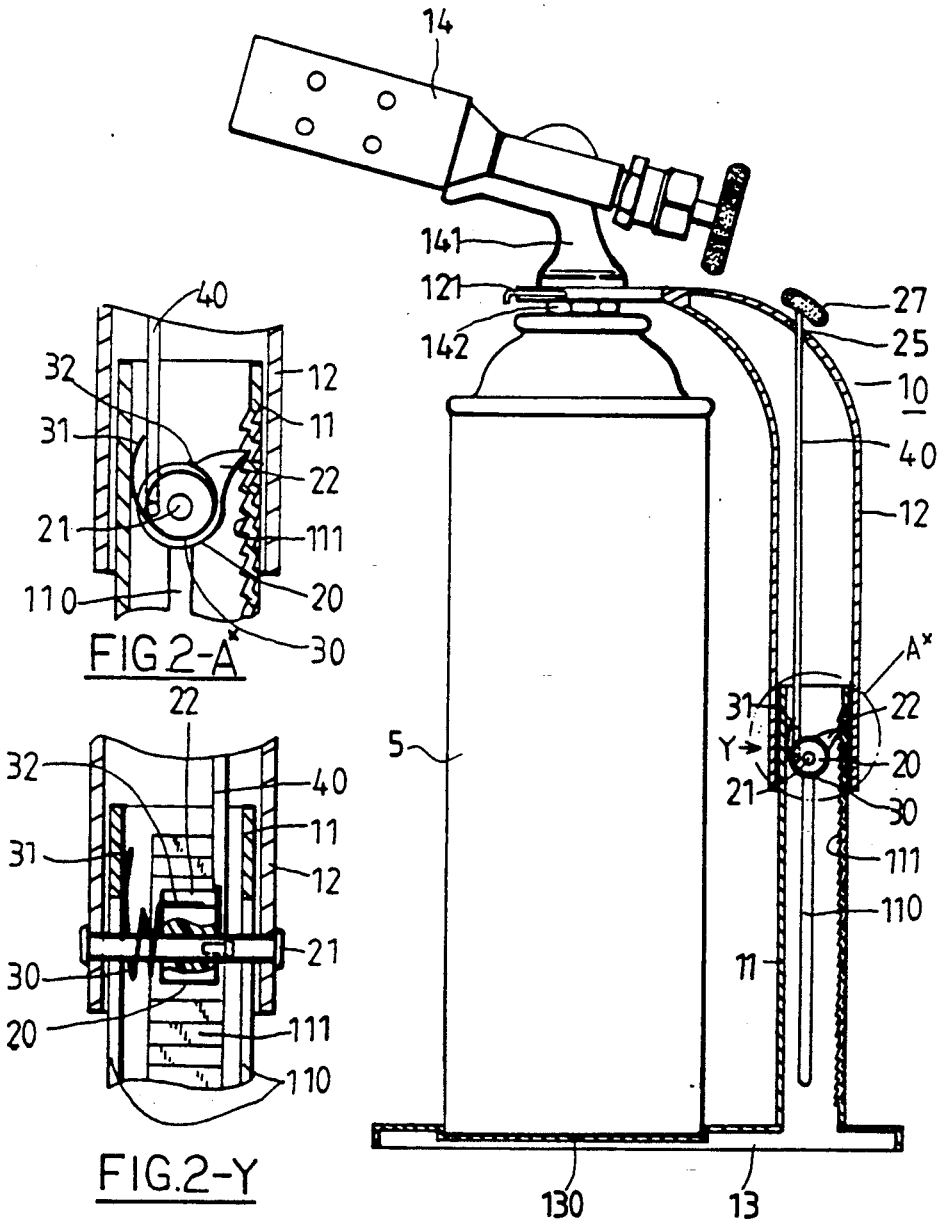
FIG. 2 is a side elevation of the blow torch with a space adjustment device vertically sectioned.

Referring to FIGS. 1 and 2, a blow torch having a space adjustment device according to the present invention comprises a tray 13 formed with a circular depression 130 in its top wall for receiving a bottom of a cassette 5 and a handle 10 with its upper end bent to form a horizontal retainer 121 for supporting a conventioanl burner 14. The retainer 121 is formed with an opening 120 in alignment with the depression 130 for fastening a bolt seat 141 of the burner 14 thereon with a nut 142.

The handle 10, which also serves as a space adjustment device, includes a lower half 11 of a tubular member and an upper half 12 having a vertical tubular portion of which the diameter of the internal passage is dimensioned slightly more than the outer diameter of the lower half 11 to enable the lower half 11 to telescope freely within the tubular portion of the upper half 12. The lower half 11 is raised from a portion beyond the depression 130 of the tray 13 and is diametrically and correspondingly formed with a pair of slots 110 along its longitudinal direction. A series of teeth 111 is aligned in an internal side wall along the longitudinal direction of the lower half 11.

The upper half 12 is diametrically and correspondingly formed with a pair of perforations 24 in a lower end of the vertical tubular portion and another perforation 25 is further formed in a neck portion thereof. A pawl 20 is turnably pivoted within the lower half 11 of the handle 10 with a pin 21 which is inserted through the diametric perforations, slots 110 and a central hole of a wheel of the pawl 20 and is riveted at its two ends. The pawl 20 has a catch 22 on the wheel with a tenon end adapted to engage a tooth of the internal teeth 111 formed in the inner side wall of the lower half 11.

A coil spring 30 is sleeved around the pin 21 and accommodated within the tubular member 11 with a first end 31 abutting against the internal side wall of the tubular member 11 and a second end 32 abutting against the catch 22 of the pawl 20 so as to bias the catch 22 towards the teeth 111. The engagement of the catch 22 to the teeth 111 allows the lower half 11 to extend in a telescopic fashion with respect to the upper half 12 yet prohibits the first half 11 from moving to collapse with respect to the upper half 12. The wheel of the pawl 20 is eccentrically and transversely formed with a hole 220 parallel to the central hole thereof for receiving a second pin 26. An actuating arm 40 extends through the internal passage of the vertical tubular portion of the upper half 12. The upper end of the actuating arm 40 is slightly protruded from the perforation 25 and attached to a knob 27, and the lower end thereof is formed with a perforation 41 which allows the second pin 26 to pass therethrough before the second pin 26 is press-fitted into the hole 220 in the wheel of the pawl 20.

Figure 4:
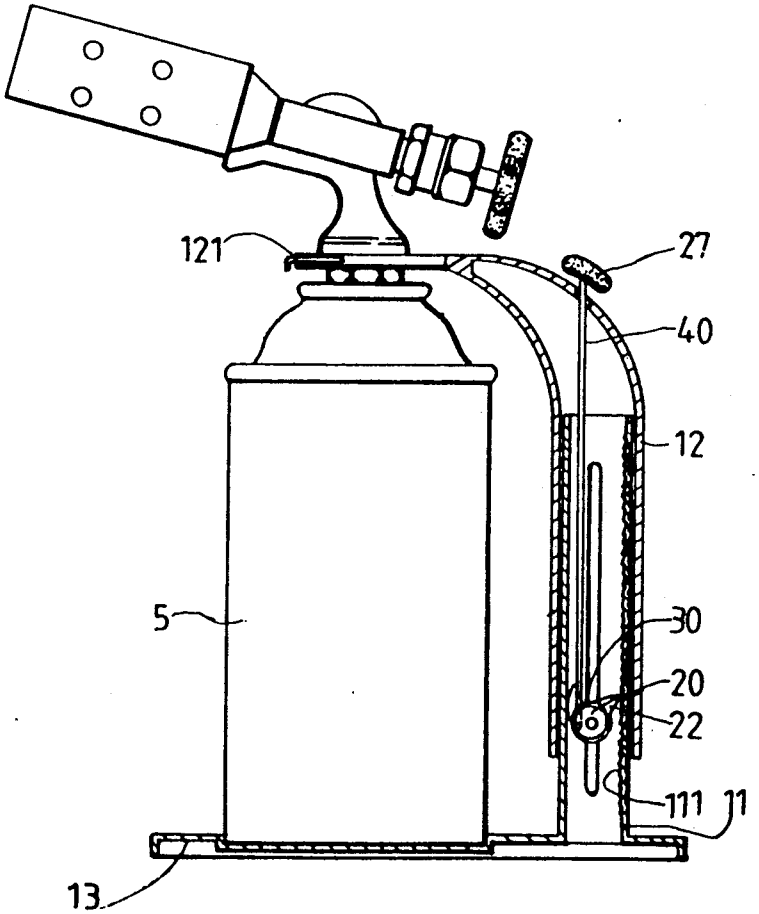
FIG. 4 is a side elevation of the blow torch which is in a collapsed position.
Figure 3:
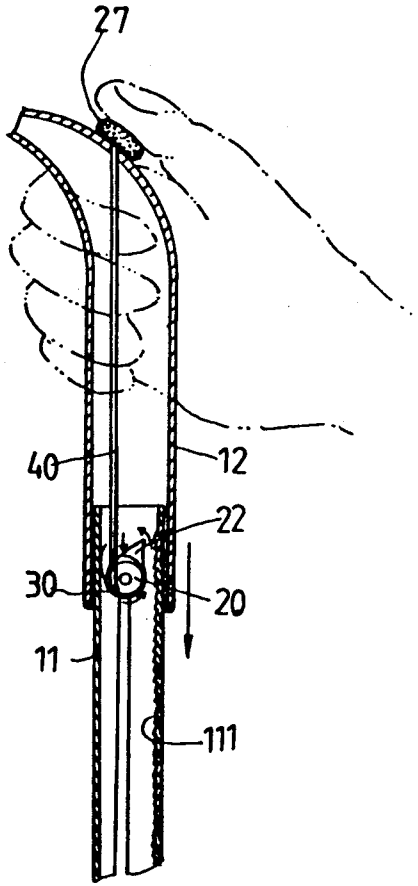
FIG. 3 is a diagrammatic view showing a collapse operation of the space adjustment device.

In operation, as shown in FIGS. 3 and 4, the actuating arm 40 can be pushed downwardly by pressing the knob 27 with a thumb to overcome the biasing force of the coil spring 30 so as to turn the wheel of the pawl 20 counterclockwise. The tenon end of the catch 22 is thus released from a corresponding tooth of the teeth 111 and the lower half 11 can move either ways in a telescopic fashion with respect to the upper half 12. A space or distance between the retainer 121 and the tray 13 becomes adjustable to fit a cassette 5 of any of the standard sizes. The actuating arm 40 will be automatically retracted by the coil spring 30 when released and the tenon end of the catch 22 will once again engage a corresponding tooth of the teeth 111.

While the invention has been described with what is presently considered to be the most practical and preferred embodiment, it is to be understood that the invention is not to be limited to the disclosed embodiment, but on the contrary, is intended to cover various modifications and eqivalent arrangements.

What I claim is:

1. A blow torch comprising:

a tray formed with a circular depression in a major portion of a top wall;

a collapsible handle including:

a first half having a tubular portion having a passageway extending along its axis from an open end to an opposite end which is bent perpendicular to the tubular portion and formed with a retainer for securing a conventional burner;

a pair of openings diagonally formed in the open end of the tubular portion of the first half;

a second half of a tubular body upraised from an outer portion of the top wall of the tray, diagonally formed with a pair of slots along its longitudinal direction and adapted to extend through the open end of the tubular portion of the first half in a telescopic manner within the passageway;

a ratchet means including:

a series of teeth aligned in an internal side wall of the second half and parallel to the slots;

a pawl accommodated in the second half and having a wheel formed with an axle hole therein and a pin hole eccentrical and parallel to the axle hole and a catch projected on the wheel and having a tenon end adapted to engage the teeth;

a coil spring accommodated in the second half and arranged to bias to rotate the wheel along a direction thereby the tenon end of the catch engages one of the teeth to lock the handle from being collapsed;

a rivet extending through the openings in the open end of the first half, the slots in the second half and the axle hole in the wheel and dimensioned to allow a rotating movement of the pawl about the rivet and sliding movement of the rivet along the slots; a release means including;

an actuating arm extending along the passageway of the tubular portion of the first half with one end slightly protruding outwards from the first half and an opposite end formed with an opening; and a pin extending through the opening of the actuating arm and press-fitted in the pin hole of the wheel of the pawl to connect the actuating arm to the wheel of the pawl in a way that the wheel can be turned along a direction to disengage the tenon end of the catch by pushing the actuating arm to overcome the biasing force of the coil spring;

whereby, by pushing the actuating arm, the pawl of the ratchet means can be turned to unlock the collapsible handle enabling a space adjustment between the tray and the retainer for fitting a gas cassette of various sizes.

* * * * *